United States Patent [19]

Das et al.

[11] Patent Number: 5,045,278

[45] Date of Patent: Sep. 3, 1991

[54] DUAL PROCESSING OF ALUMINUM BASE METAL MATRIX COMPOSITES

[75] Inventors: Sontosh K. Das; Michael S. Zedalis, both of Randolph, N.J.; Paul S. Gilman, Suffern, N.Y.

[73] Assignee: Allied-Signal Inc., Morris Township, Morris County, N.J.

[21] Appl. No.: 433,875

[22] Filed: Nov. 9, 1989

[51] Int. Cl.[5] ..... B22F 1/00; C22C 21/00; C22C 29/12

[52] U.S. Cl. ..... 419/16; 75/233; 75/351; 148/437; 419/33; 419/45; 419/48; 419/60; 420/528

[58] Field of Search ..... 420/590, 528, 529, 552; 419/61, 62, 66–69; 75/0.5 R, 233, 249; 148/437–440, 11.5 A, 11.5 P

[56] References Cited

U.S. PATENT DOCUMENTS

| | | | |
|---|---|---|---|
| 3,591,362 | 7/1971 | Benjamin | 75/0.5 BA |
| 4,594,222 | 6/1986 | Heck et al. | 420/529 |
| 4,624,705 | 11/1986 | Jatkar et al. | 420/528 |
| 4,627,959 | 12/1986 | Gilman et al. | 419/61 |
| 4,722,751 | 2/1988 | Akechi et al. | 75/232 |

*Primary Examiner*—R. Dean
*Assistant Examiner*—Robert R. Koehler
*Attorney, Agent, or Firm*—Ernest D. Buff; Gerhard H. Fuchs

[57] ABSTRACT

An aluminum based metal matrix composite is produced from a charge containing a rapidly solidified aluminum alloy, a carbidiferous agent and particles of a reinforcing material present in an amount ranging from about 0.1 to 50% by volume of the charge. The charge is ball milled energetically to uniformly mix the carbidiferous agent within the aluminum matrix, and to enfold metal matrix material around each of the particles while maintaining the charge in a pulverulent state. Upon completion of the ball milling step, the charge is hot consolidated at suitable temperatures to decompose the carbidiferous agent and result in the formation of carbide and oxide particles, and to provide a powder compact having a formable, substantially void-free mass. The compact is especially suited for use in aerospace, automotive, electronic, wear resistance critical components, and the like, which often encounter service temperatures approaching 500° C.

14 Claims, 3 Drawing Sheets

DUAL PROCESSING OF ALUMINUM BASE METAL MATRIX COMPOSITES

BACKGROUND OF THE INVENTION

1. Field of the Invention

This invention relates to a process for improving the mechanical properties of metals, and more particularly to a process for stabilizing an aluminum composite having a rapidly solidified metal matrix and reinforcing phases by incorporation of oxides and carbides through mechanical alloying.

2. Description of the Prior Art

An aluminum based composite is generally comprised of two components—an aluminum alloy matrix and a hard reinforcing second phase. The composite typically exhibits at least one characteristic reflective of each component. For example, an aluminum based metal matrix composite should to reflect the ductility and fracture toughness of the aluminum matrix and the elastic modulus and thermal stability of the reinforcing phase.

Aluminum based metal matrix composites containing particulate reinforcements are usually limited to ambient temperature applications because of the large mismatch in higher temperature strength between the aluminum matrix (low strength) and the particle reinforcement (high strength). Another problem with aluminum based metal matrix composites is that the dispersed strengthening phase is not stable at elevated temperatures, and coarsens after excessive thermal exposure, which in turn leads to a degradation of the materials' mechanical properties. Another problem with aluminum based metal matrix composites is the difficulty of producing a bond between the matrix and the reinforcing phase. To produce such a bond, it is often times necessary to vacuum hot press the material at temperatures higher than the incipient melting temperature of the matrix. It has been proposed that this technique be avoided by mechanically alloying the matrix with the addition of particulate reinforcements. This procedure, referred to as solid state bonding, permits the reinforcing phase to be bonded to the matrix without heating the material to a temperature above the solidus of the matrix. Moreover, it has been further proposed that mechanical alloying be performed with the addition of a carbidiferous agent, e.g., stearic acid, which will become uniformly dispersed within the aluminum base matrix powder during processing, and subsequently will decompose during vacuum hot degassing and/or hot consolidation, e.g., extrusion, forging, rolling, and form carbides and oxide particles dispersed within the matrix.

Although carbidiferous agents, said to be necessary for the mechanical alloying of aluminum base alloys, can become constituents in the final product (see, for example U.S. Pat. No. 4,627,959), prior art teachings suggest that the resulting $Al_4C_3$ particles are not suitable for use at temperatures greater than 100° C. Specifically, it has been taught that upon exposure to temperatures above 100° C., age hardened structures and/or work hardened structures tend to soften. At higher temperatures the dispersion of $Al_4C_3$ in the alloy is said to coarsen, thus lessening the contribution of carbide to the strength of the alloy. In consequence, aluminum base alloys of the prior art as produced by mechanical alloying are said to be generally unsuitable for use in the temperature range of 100° C. to 500° C. These aluminum carbides and oxides will provide further reinforcements in mechanical and physical properties at ambient and elevated temperatures. Prior processes in which aluminum based alloys and/or metal matrix composites are mechanically alloyed by means of solid state bonding are disclosed in U.S. Pat. Nos. 4,722,751, 4,594,222 and 3,591,362.

For the above reasons, in use of a carbidiferous processing aid, it has been proposed (see U.S. Pat. No. 4,624,705) that strong carbide formers such as titanium be added to produce in the final alloy carbides more thermally stable than $Al_4C_3$ at temperatures in excess of 100° C.

SUMMARY OF THE INVENTION

The present invention provides a process for producing a stabilized aluminum composite suitable for use at temperatures approaching 500° C. wherein a strong carbide former is not needed. The composite produced by the process has a rapidly solidified metal matrix and reinforcing phases. Oxides and carbides are incorporated within the metal matrix by mechanical alloying to improve thermal stability and increase elevated temperature strength and creep resistance of the composite. The ability to mechanically alloy the rapidly solidified material is not dependent on the presence of a carbidiferous agent. Advantageously, the desired volume friction of resulting carbides and oxides can be engineered into the material without the restrictions heretofore required to control the mechanical alloying process.

More specifically, the invention provides a process for producing a composite material comprising the steps of forming a charge containing, as ingredients, a rapidly solidified aluminum alloy, a carbidiferous agent in an amount ranging from about 0.01 to 10 wt. percent and particles of a reinforcing material such as a hard carbide, oxide, boride, carbo-boride, nitride or a hard intermetallic compound, the reinforcing material being present in an amount ranging from about 0.1 to 50 % by volume of the charge, and ball milling the charge energetically to mix the carbidiferous agent within the aluminum matrix, and to enfold metal matrix material around each of the reinforcing particles while maintaining the charge in a pulverulent state. In this manner there is provided a strong bond between the matrix material and the surface of the reinforcing particle. Upon completion of the ball milling step, the resultant powder is hot pressed or sintered using conventional powder metallurgical techniques, to react the aluminum matrix with the carbidiferous agent resulting in the formation of carbides and oxides, and to form a powder compact having a mechanically formable, substantially void-free mass. The compressed and treated powder compact is then mechanically worked to further react the carbidiferous agent and the aluminum matrix, and to increase its density and provide engineering shapes suitable for use in aerospace components such as stators, wing skins, missile fins, actuator casings, electronic housings and other wear resistance critical parts, automotive components such as piston heads, piston liners, valve seats and stems, connecting rods, cam shafts, brake shoes and liners, tank tracks, torpedo housings, radar antennae, radar dishes, space structures, sabot casings, tennis racquets, golf club shafts and the like.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1A:
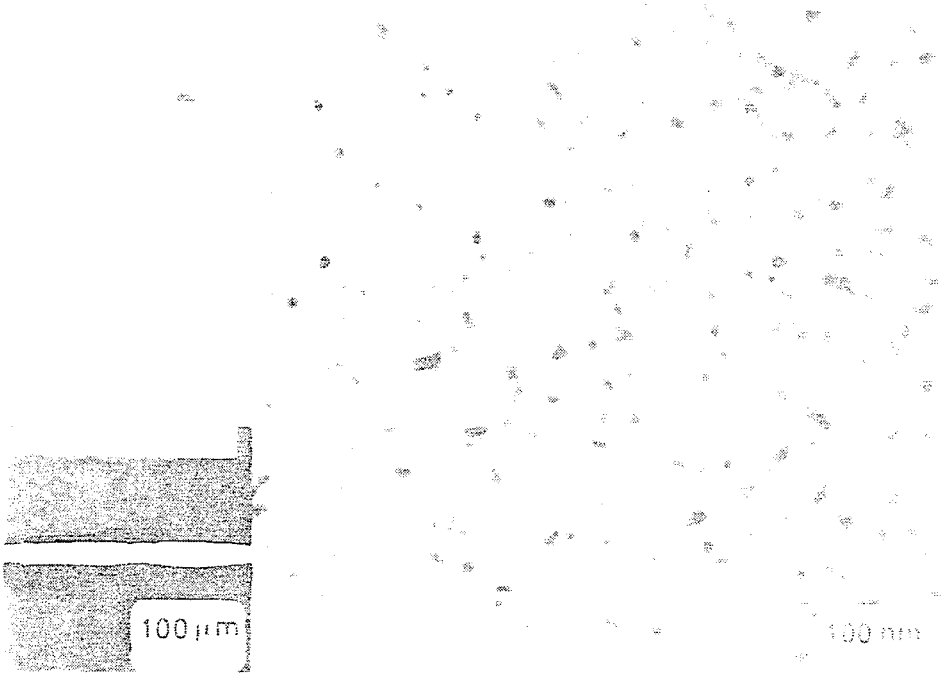
FIGS. 1A and 1B are transmission electron micrographs of a rapidly solidified aluminum based iron, vanadium and silicon containing alloy ribbon and a rapidly solidified aluminum based titanium containing alloy ribbon produced by melt spinning.

The aluminum base, rapidly solidified alloy appointed for use in the process of the present invention has a composition consisting essentially of the formula $Al_{bal}Fe_aSi_bX_c$ wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0:1 to 5.0:1. Examples of the alloy include aluminum-iron-vanadium-silicon compositions wherein the iron ranges from about 2.0–7.5 at %, vanadium ranges from about 0.05–3.5 at %, and silicon ranges from about 0.5–3.0 at %.

Another aluminum base, rapidly solidified alloy suitable for use in the process of the invention has a composition consisting essentially of the formula $Al_{bal}Fe_aSi_bX_c$ wherein X is at least one element selected from the group consisting of Mn, V, Cr, Mo, W, Nb, Ta, "a" ranges from 1.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

Still another aluminum base, rapidly solidified alloy that is suitable for use in the process of the invention has a composition range consisting essentially of about 2–15 at % from a group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

Rapid solidification of those alloys is accomplished in numerous ways, including planar flow or jet casting methods, melt extraction, splat quenching, atomization techniques and plasma spray methods. These metal alloy quenching techniques generally comprise the step of cooling a melt of the desired composition at a rate of at least about $10^{5}$° C./sec. Generally, a particular composition is selected, powders or granules of the requisite elements in the desired portions are melted and homogenized, and the molten alloy is rapidly quenched on a chill surface, such as a rapidly moving metal substrate, an impinging gas or liquid.

When processed by these rapid solidification methods the aluminum alloy is manifest as a ribbon, powder or splat of substantially uniform structure. This substantially uniformly structured ribbon, powder or splat may then be pulverized to a particulate for further processing. By following this processing route to manufacture the aluminum matrix, the resultant microstructure is significantly refined and homogeneous. Such microstructural improvements typically result in improved ambient and elevated temperature strength, fracture toughness and ductility when compared to alloys of similar composition fabricated by conventional ingot casting or other techniques wherein the molten metal cools at relatively slow rates. The aluminum matrix material must be provided as a particulate that can range in size from 0.64 cm in diameter down to less than 0.0025 cm in diameter. For the purposes of this specification and claims the term "hard", as applied to particles which may form the reinforcing phase of the resultant composite shall generally imply (1) a scratch hardness in excess of 8 on the Ridgway's Extension of the MOHS' Scale of Hardness, and (2) an essentially non-malleable character. However, for the aluminum matrices of this invention somewhat softer reinforcing particles such as graphite particles may be useful. Hard particles useful in the process of this invention include filamentary or non-filamentary particles of silicon carbide, aluminum oxide and/or aluminum hydroxide (including additions thereof due to its formation on the surface of the aluminum matrix material), zirconia, garnet, cerium oxide, yttria, aluminum silicate, including those silicates modified with fluoride and hydroxide ions, silicon nitride, boron nitride, boron carbide, simple or mixed carbides, borides, carbo-borides and carbonitrides of tantalum, tungsten, zirconium, hafnium and titanium, and intermetallics such as $Al_3Ti$, AlTi, $Al_3$(V, Zr, Nb, Hf and Ta), $Al_7V$, $Al_{10}V$, $Al_3Fe$, $Al_6Fe$, $Al_{10}Fe_2Ce$, and $Al_{12}$(Fe, Mo, V, Cr, Mn)$_3$Si. Such particles of reinforcing material may be present in an amount ranging from about 3 to 25% by volume, and preferably 5 to 15% by volume. In particular, because the present invention is concerned with aluminum based composites that possess a relatively low density and high modulus, silicon carbide and boron carbide are desirable as the reinforcing phase. However, other particulate reinforcements may prove to form superior matrix/reinforcement bonds. Also, the present specification is not limited to single types of reinforcement or single phase matrix alloys.

As used herein, the term "carbidiferous agent" means carbon based material including compounds and mixtures such as stearic acid, methanol, oxalic acid, etc. as well as carbonitrides and carbides containing free carbon.

The term "energetic ball milling" in the context of the present specification and claims means milling at prescribed conditions where the energy intensity level is such that the hard reinforcing phase and/or the carbidiferous agent is optimately kneaded into the aluminum matrix. As used herein, the phrase "prescribed conditions" means conditions such that the ball mill is operated to physically deform, fracture, cold weld and re-fracture the matrix metal alloy powder so as to distribute the reinforcing phase and/or carbidiferous agent therewithin. The phrase "optimately kneaded", as used herein, means that the reinforcing phase and/or carbidiferous agent is distributed more uniformly than the distribution produced by simple mixing or blending, and approaches a substantially homogeneous distribution of reinforcing material and/or processing control agent within the matrix. Energetic ball mills include vibratory mills, rotary ball mills and stirred attritor mills.

After the ball milling step is completed, the resultant powder is compacted alone or mixed with additional matrix material, under conditions to promote the decomposition of the carbidiferous agent, and formation of carbides and oxides. Consequently, the resultant composite compact is vacuum hot pressed or otherwise treated under conditions such that the carbidiferous agent decomposes and reacts with the aluminum matrix, and that no significant melting of the matrix occurs. Generally, the consolidation step is carried out at a temperature ranging from about 400° C. to 600° C., and preferably from about 450° C. to 550° C., the temperature being below the solidus temperature of the metal matrix. The Al-Fe-V-Si alloy composite containing a carbidiferous agent and silicon carbide reinforcements may be canless vacuum hot pressed at a temperature ranging from 435° C. to 500° C. and more preferably from 450° C. to 475° C., followed by forging or extrusion.

Those skilled in the art will appreciate that other time/temperature combinations can be used and that other variations in pressing and sintering can be employed. For example, instead of canless vacuum hot pressing the powder can be placed in metal cans, such as aluminum cans having a diameter as large as 30 cm or more, hot degassed in the can, sealed therein under vacuum, and thereafter reheated within the can and compacted to full density, the compacting step being conducted, for example, in a blind died extrusion press. In general, any technique applicable to the art of powder metallurgy which does not involve liquefying (melting) or partially liquefying the matrix metal can be used. Representative of such techniques are explosive compaction, cold isostatic pressing, hot isostatic pressing and direct powder extrusion. The resultant billet can then be worked into structural shapes by forging, rolling, extrusion, drawing and similar metal working operations.

EXAMPLE I

Figure 1B:
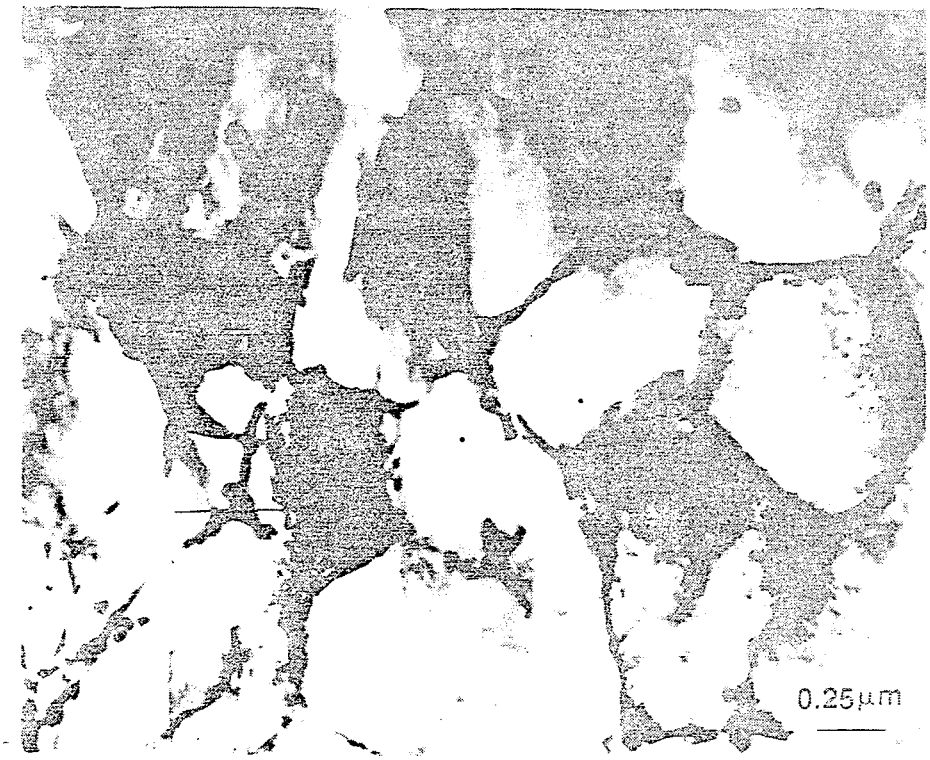

Ten kilogram batches of aluminum alloys of the compositions aluminum = balance, 4.06 at % iron, 0.70 at % vanadium, 1.51 at % silicon (hereinafter designated Alloy A), and aluminum-balance, 4.7 at % titanium (hereinafter designated Alloy B) were produced by planar flow casting. Transmission electron photomicrographs of the rapidly solidified ribbon are shown in FIGS. 1A and 1B, respectively. The aluminum—iron—vanadium—silicon base alloy microstructure is composed of a microcellular network of aluminum intermetallic compound particles, $Al_{13}(Fe,V)_3Si$, uniformly distributed in the aluminum solid solution network. The aluminum—titanium base alloy microstructure is composed of titanium-rich cell boundaries, within which is a uniform distribution of fine aluminum intermetallic compound particles, $Al_3Ti$.

Figure 2A:
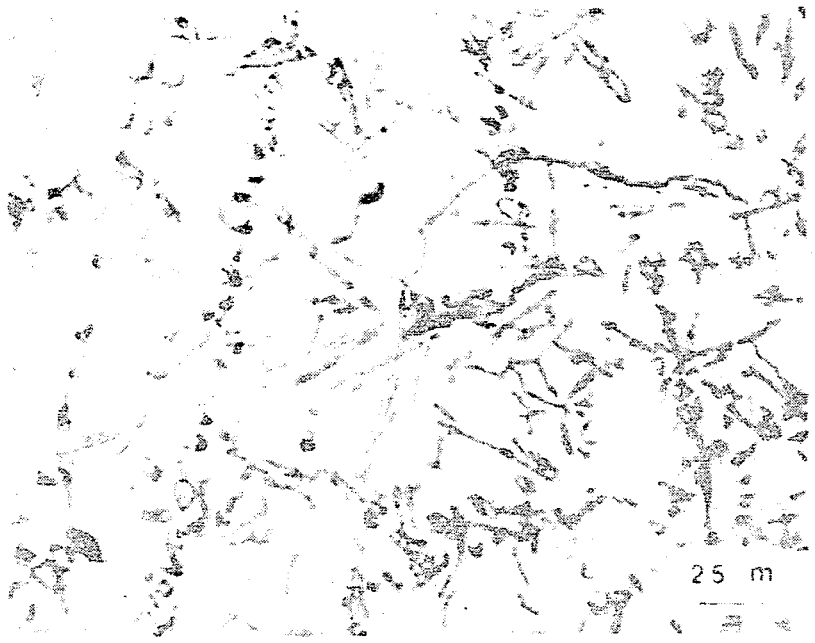
FIGS. 2A and 2B are photomicrographs of an aluminum based iron, vanadium and silicon containing alloy and an aluminum based titanium containing alloys fabricated by conventional ingot casting.
Figure 2B:
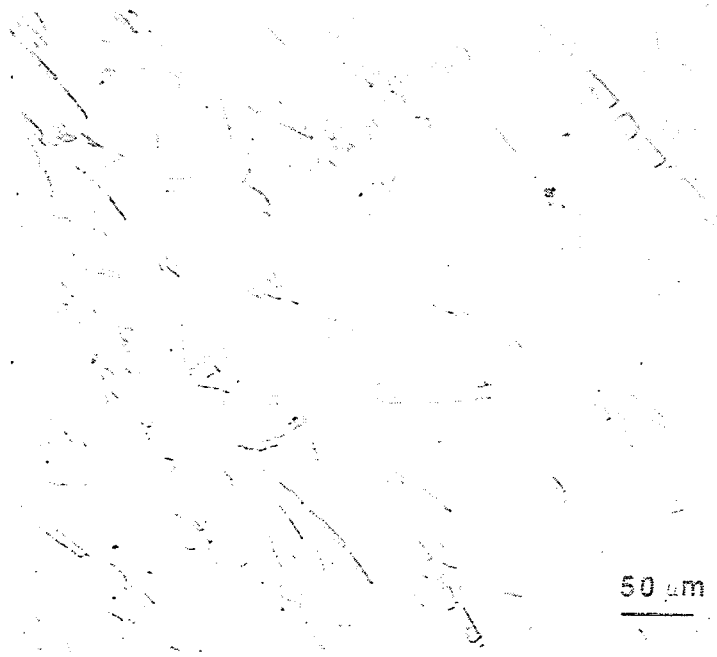

For comparison, light photomicrographs of these two alloys made by conventional ingot casting are shown in FIGS. 2A and 2B respectively. The dispersed phases present in these alloys are observed to be much coarser and less uniformly distributed than the dispersed phases formed in planar flow cast alloys.

EXAMPLE II

Figure 3:
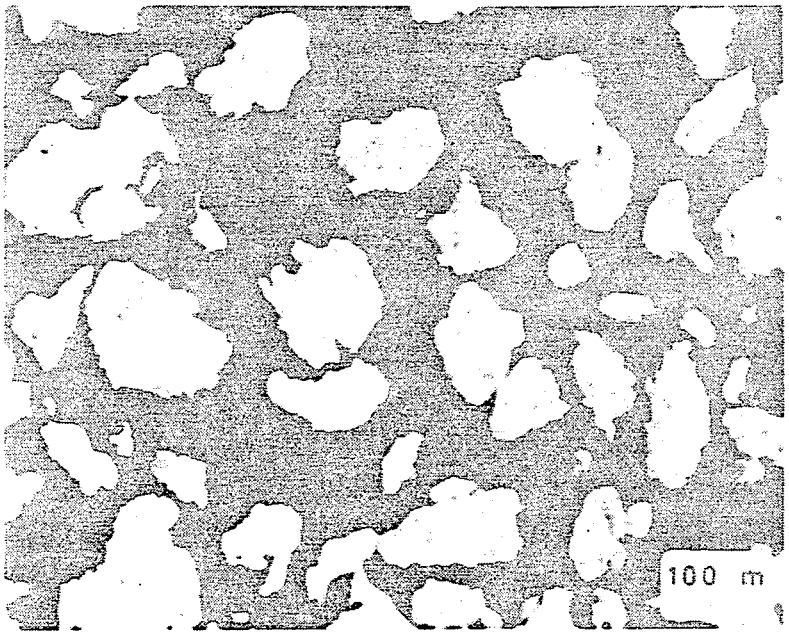
FIG. 3 is a photomicrograph of a rapidly solidified aluminum based titanium based containing alloy powder having about 8 % by volume aluminum carbide particles substantially uniformly distributed therein in accordance with the present invention.

A five gram sample of -40 mesh (U.S. standard sieve) powder of Alloy A was added to 0.10 grams of Nopcowax ®, i.e., stearic acid. The sample was processed by pouring the powders into a Spex Industries hardened steel vial (Model #8001) containing 31 grinding balls. Each of the balls had a diameter of about 0.365 cm and was composed of Alloy SAE 52100 steel. The filled vials were then sealed and placed into a Spex Industries 8000 mixer mill. The powder batch containing about 8 vol. % $Al_4C_3$ particles was then processed for 240 min. The processing procedure described above provides a composite aluminum base alloy with silicon carbide particulate in the form of powder particle that exhibit a substantially uniform dispersion of the carbidiferous agent and the reinforcement, and strong aluminum metal to aluminum carbide bonding. A photomicrograph of said composite powder particles containing 8 vol. % $Al_4C_3$ particulate that have been processed for 240 min. is shown in FIG. 3.

Having thus described the invention in rather full detail, it will be appreciated that such detail need not be strictly adhered to but that various changes and modifications may suggest themselves to one skilled in the art, all falling within the scope of the invention as defined by the subjoined claims.

We claim:

1. A process for producing a composite having a metal matrix and a reinforcing phase, comprising the steps of:

(a) forming a charge containing, as ingredients, a rapidly solidified aluminum base alloy, a carbidiferous agent in an amount ranging from about 0.01 to 10 % by wt, and particles of a reinforcing material present in an amount ranging from about 0.1 to 50 % by vol. of said charge;

(b) ball milling the charge energetically to mix the carbidiferous agent within the aluminum matrix, and to enfold metal matrix material around each of said particles while maintaining the charge in a pulverulent state; and (c) consolidating said charge to react the aluminum matrix with the carbidiferous agent resulting in the formation of carbides and oxides, and to provide a mechanically formable, substantially void-free mass.

2. A process as recited in claim 1, wherein said rapidly solidified aluminum based alloy has a substantially uniform structure.

3. A process as recited in claim 2, wherein said rapidly solidified aluminum based alloy is prepared by a process comprising the steps of forming a melt of the aluminum based alloy and quenching the melt on a moving chill surface at a rate of at least about $10^{5°}$ C./sec.

4. A process as recited in claim 3, wherein said ball milling step is continued until said carbidiferous agent and/or said particles are enveloped in and bonded to said matrix material.

5. A process a recited in claim 4, wherein said consolidation step is carried out at a temperature ranging from about 400° C. to 600° C., said temperature being below the solidus temperature of said metal matrix.

6. A process as recited in claim 5, wherein said consolidation step comprises vacuum hot pressing at a temperature ranging from about 450° C. to 550° C.

7. A process as recited in claim 3, wherein said rapidly solidified aluminum based alloy has a composition consisting essentially of the formula $Al_{bal}Fe_aSi_bX_c$ wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0:1 to 5.0:1.

8. A process as recited in claim 7, wherein said rapidly solidified aluminum based alloy is selected from the group consisting of the elements Al-Fe-V-Si, wherein the iron ranges from about 2.0–7.5 at %, vanadium ranges from about 0.05–3.5 at %, and silicon ranges from about 0.5–3.0 at %.

9. A process as recited in claim 3, wherein said rapidly solidified aluminum based alloy has a composition consisting essentially of the formula $Al_{bal}Fe_aSi_bX_c$ wherein X is at least one element selected from the group consisting of Mn, V, Cr, Mo, W, Nb, Ta, "a" ranges from 2.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

10. A process as recited in claim 3, wherein said rapidly solidified aluminum based alloy has a composition consisting essentially of about 2–15 at % from a group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

11. A process as recited in claim 4, wherein said carbidiferous agent is selected from the group consisting of stearic acid, methanol, graphite, and oxalic acid.

12. A process as recited in claim 4, wherein said particles are selected from the group consisting of carbides, borides, nitrides, oxides and intermetallic compounds.

13. A process as recited in claim 12, wherein said particles are selected from the group consisting of silicon carbide and boron carbide particles.

14. A process as recited in claim 4, wherein said particles of reinforcing material and said carbidiferous agent are substantially uniformly distributed within said matrix material.

* * * * *